United States Patent [19]

Mathias

[11] Patent Number: 4,905,983

[45] Date of Patent: Mar. 6, 1990

[54] TRANSPORTING LIMP FABRIC

[75] Inventor: Anthony D. Mathias, Victoria, Australia

[73] Assignee: Pacific Dunlop Limited, Victoria, Australia

[21] Appl. No.: 230,412

[22] Filed: Aug. 10, 1988

Related U.S. Application Data

[62] Division of Ser. No. 943,263, Nov. 14, 1986, Pat. No. 4,781,369.

[51] Int. Cl.[4] ..... B65H 5/04

[52] U.S. Cl. ..... 271/267; 271/84; 271/306; 271/182

[58] Field of Search ..... 271/267, 268, 84, 85, 271/182, 306, 307, 180, 181, 183, 213, 220; 112/121.15, 121.29, 121.12, 121.14

[56] References Cited

U.S. PATENT DOCUMENTS

| | | | |
|---|---|---|---|
| 3,358,626 | 12/1967 | Bryan | 112/121.12 |
| 3,405,670 | 10/1968 | Scholl | 112/121.12 |
| 3,405,932 | 10/1968 | Dame | 271/84 X |
| 3,604,015 | 9/1971 | Dove | 2/406 X |
| 4,102,284 | 7/1978 | Rohr | 271/84 X |

*Primary Examiner*—Richard A. Schacher
*Attorney, Agent, or Firm*—Fred Philpitt

[57] ABSTRACT

A method and apparatus for transferring a limp fabric piece (6) wherein the fabric piece (6) is deposited on a low frictional plate (7) supported by a movable carriage (not shown) mounted on wheels (10). The carriage is then moved to a position beneath a frictional gripping device (9) which is then lowered onto the fabric piece (6). The carriage with the low friction plate (7) is then withdrawn from beneath the gripping device (9) and returned to its original position leaving gripping device (9) in frictional engagement with fabric piece (6).

6 Claims, 3 Drawing Sheets

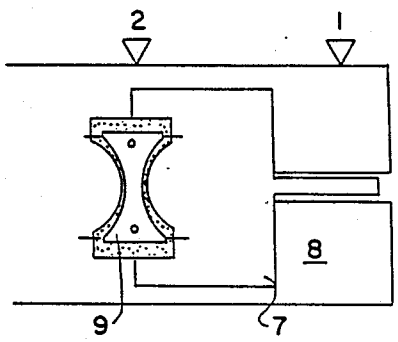
FIG. IC
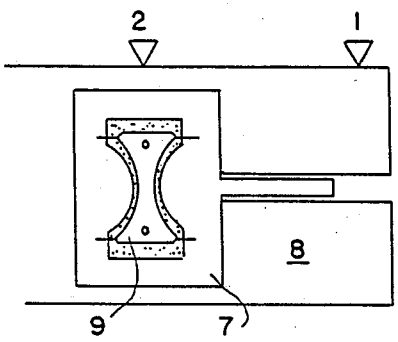
FIG. IB
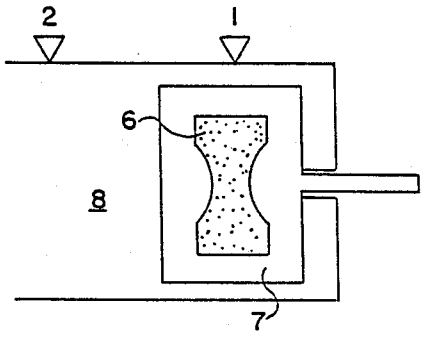
FIG. IA

TRANSPORTING LIMP FABRIC

This is a division of application Ser. No. 943,263, filed Nov. 14, 1986, now U.S. Pat. No. 4,781,369, and the benefits of 35 USC 120 are claimed relative to it.

This invention relates to the transporting of limp fabric in a manufacturing process involving the fabrication of garments from said fabric.

The fabrication of garments from fabric is currently a labour intensive process principally because of the lack of mechanical means for transporting and feeding fabric to and through various machines such as sewing machines, which perform operations on the fabric.

It is the principal object of the present invention to provide a method and apparatus to effectively transport pieces of limp fabric to and/or through one or more work stations wherein operations may be carried out on the fabric piece.

There is thus provided by the present invention a method of transferring a limp fabric piece comprising:

supporting the fabric piece in a flat state on a flat low friction surface at one location, moving the surface with the fabric piece thereon to position the fabric piece in a selected location above a further flat surface, frictionally engaging the exposed surface of the fabric piece to hold it in said flat state at said selected location, and removing the low friction surface from between the fabric piece and the further surface so the fabric piece is deposited in the flat state on the further surface.

Conveniently the fabric piece is frictionally engaged at a plurality of spaced locations on the exposed surface, the locations being selected so the fabric piece will remain in a flat state as and/or after the low friction surface has been withdrawn. The locations may be spaced along a marginal portion of the fabric piece that lies across the direction of withdrawal of the low friction surface, and opposite from the edge from which it is withdrawn.

Alternatively the fabric piece may be frictionally engaged along, or at spaced locations along, or along a major portion of one or two marginal portions of the fabric piece. Preferably the frictional engagement is along two opposite marginal portions of the fabric piece, such as opposite marginal portions extending in a direction transverse to the direction of movement of the low friction surface.

Conveniently two limp fabric pieces may be arranged in a superimposed relation, and at least the lower of the two is frictionally engaged as the low friction surface is withdrawn. One of the fabric pieces may be the body portion of a pair of briefs, pants or underpants and superimposed thereon is a gusset fabric piece.

The method according to the present invention may include the further steps of moving the fabric piece or pieces while maintained in said flat state along said further flat surface, and by said movement passing the or at least one fabric piece through a sewing machine head to perform a sewing operation on the fabric piece or pieces.

Conveniently the two fabric pieces are arranged in superimposed relation and the sewing operation sews the pieces together. The fabric piece or pieces may be passed through two sewing heads in succession or simultaneously, and when two fabric pieces are in superimposed relation, the two sewing operations may sew the pieces together along two opposite marginal portions of the upper fabric piece.

The fabric pieces may pass through the sewing head in a linear or non-linear movement. This movement may be performed in accordance with the method and/or by the apparatus disclosed in our co-pending PCT/AU85/00175 patent application.

There is also provided by the present invention apparatus for transferring a limp fabric piece comprising:

a transfer member having a flat low friction upper surface portion with a terminal edge to support thereon in a flat state a limp fabric piece, means supporting said transfer member for movement in a direction normal or inclined to said terminal edge in each direction between first and second stations, a receiving member having a flat upper surface portion located to underlie the low friction surface portion when the transfer member is at said second station, means at said second station operable to frictionally engage the exposed surface of a limp fabric piece supported on the low friction surface when the transfer member is at the second station, said frictional engaging means and said low friction surface been adapted so that when the fabric piece is frictionally engaged and as the transfer member moves from the second station towards the first station the fabric piece is withdrawn from the transfer member over the terminal edge to be supported in a flat state on the upper surface portion of the receiving member.

Conveniently the frictional engaging means is selectively movable relative to the upper surface portion of the receiving member to engage the fabric piece when the transfer member is at said second station. The frictional engaging means may be arranged to engage the fabric piece at a plurality of spaced locations selected so the fabric piece will remain in a flat state as and/or after the transfer member has been withdrawn. The location may be arranged along one or more, preferably two opposite, marginal portions of the fabric piece.

The frictional engaging means may comprise a plate having a configuration substantially identical to, but smaller than, said fabric piece, said plate having along the periphery of the surface engaging said fabric piece, a strip of high friction material.

The flat low friction portion of the upper surface of the transfer member may be a polished metal surface. The part of the transfer member which provides said low friction portion is preferably only a few millimeters thick, such as about 2 to 3 mm, so the fabric piece is only lowered a small distance onto the receiving member as the transfer member is withdrawn. The frictional engaging means are arranged to provide a degree of resilience and/or flexibility so the engagement with the fabric piece is maintained as the support of the fabric piece transfers from the transfer member to the receiving member.

The transfer member may conveniently comprise a carriage mounted on wheels pneumatically actuated for reciprocal movement and a thin polished metal blade mounted on said carriage.

The invention will now be described and illustrated with reference to the accompanying drawings wherein:

FIGS. 1A–1C are diagrammatic representations of the method of transferring a limp fabric piece, according to this invention, in three stages from station 1 to station 2;

Figure 2:
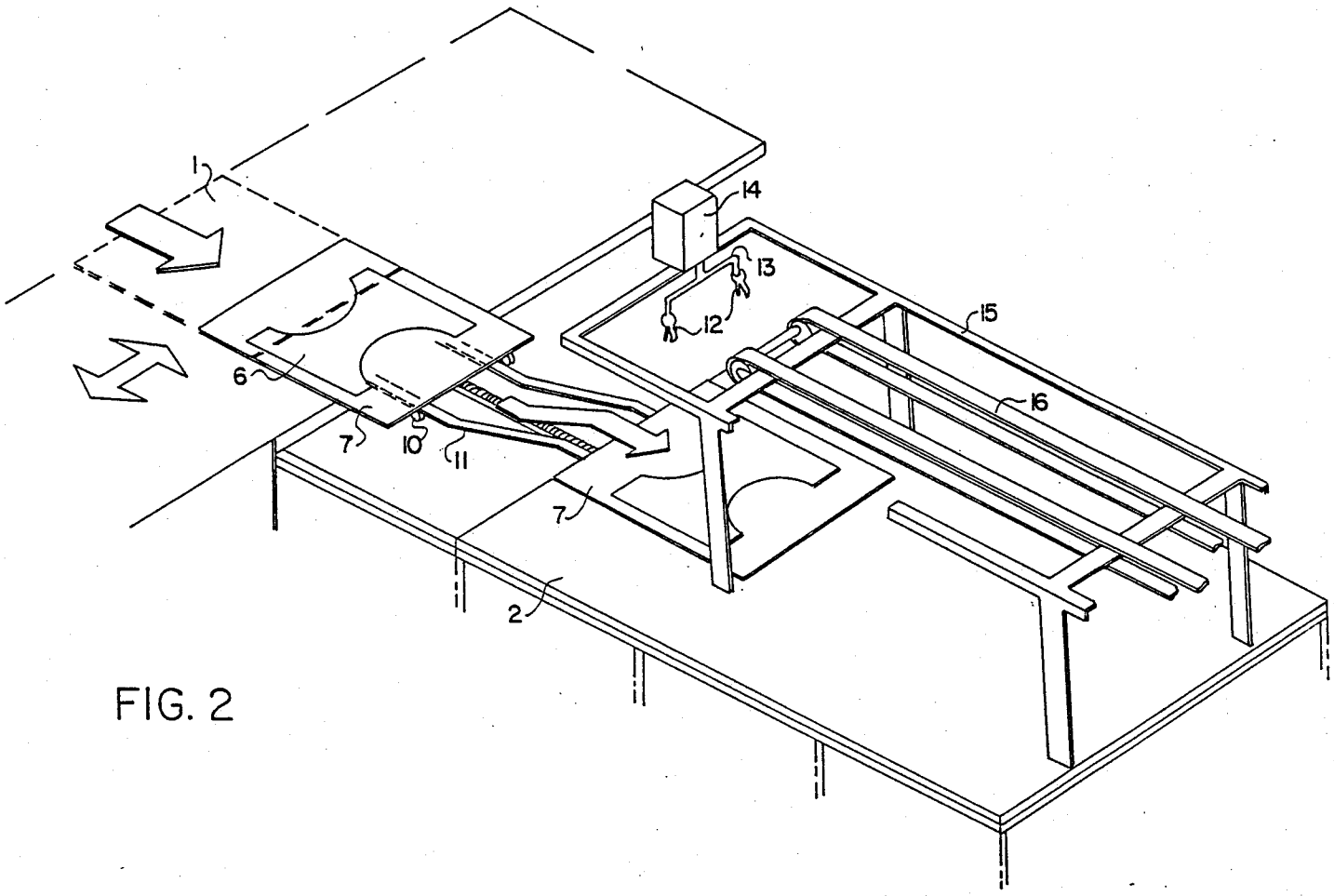
FIG. 2 shows the apparatus according to this invention for transferring limp fabric.

Referring to the drawings, fabric piece 6 is delivered by a suitable equipment onto the upwardly directed low friction surface of the plate 7. The plate 7 is of a rigid nature and preferably is metal, such as aluminum, with the upper surface polished to provide a suitable low friction finish. Plate 7 is supported by a carriage (not shown) supported by a plurality of wheels 10 moving on a pair of tracks 11 which extend to a position beneath a bench 8 along which the fabric piece 6 will travel while subject to various manufacturing processors. The aforementioned position is such as to allow plate 7 (at station 2) and hence fabric 6, to be directly beneath a frictional gripping device 9 (to be lowered onto the fabric piece 6) for further transporting said fabric piece 6. The bench 8 has a pair of recesses (not shown) for allowing access to the wheels 10 to bench 8. The upper surface of the bench 8 is likewise of a relatively low friction nature and may conveniently be in the form of polished metal or one of the many known polished finish composite laminate sheets. When plate 7 arrives at station 2 it rests flat of the bench 8, and will slide freely thereon.

The carriage supporting plate 7 is attached to and actuated by a suitable mechanism to effect movement of the carriage between stations 1 and 2. The movement of the carriage may be effected by an air actuated pistonless cylinder controlled to achieve reciprocating movement of the plate 7 between stations 1 and 2 in time relation with other operations of the machine.

The fabric piece 6 is initially deposited on the plate 7 by any suitable means, such as the apparatus described in our co-pending Patent Application no. PCT AU84/00169. Further, as described in that co-pending patent application two superimposed pieces of fabric may be deposited on to the plate 7 in sequence. The carriage supporting plate 7 is then advanced from station 1 to station 2 under the action of an air cylinder. After the plate 7 has become stationary at station 2, frictional gripping device 9 (shown in FIGS. 3A to 3D) is lowered onto the fabric piece 6.

Frictional gripping device 9 may be raised and lowered by a pair of clamps 12 mounted on arm 13, both clamps 12 and arm 13 being actuated for clamping/unclamping and up/down movement respectively by air actuating mechanism 14 mounted on frame 15. Clamps 12 co-operate with pins 15 to effect clamping of the frictional gripping device 9 (of FIGS. 3A to 3D).

Frame 15 also supports a conveyor system 16 for transporting a plurality of said frictional gripping devices 9 to said clamps 12 for lowering onto said fabric piece 6 at station 2.

Figure 3A:
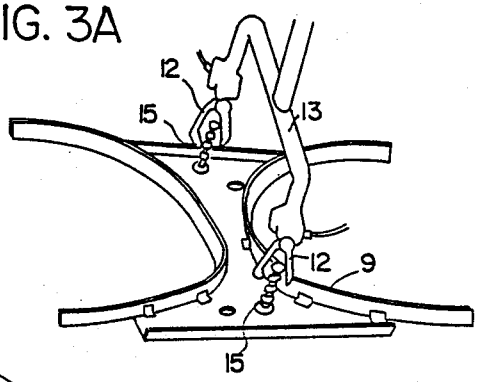
FIGS. 3A to 3D show an embodiment of the frictional engaging means at various stages before and in contact with the limp fabric.
Figure 3B:
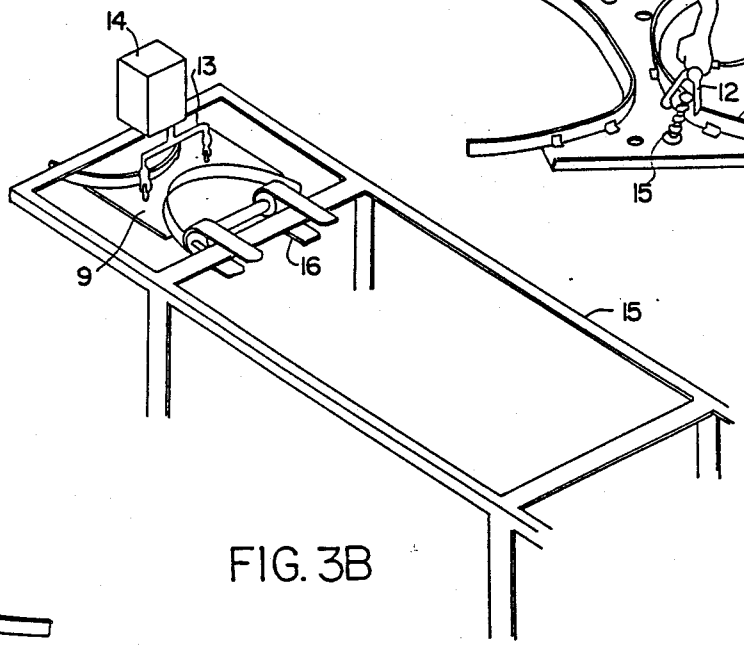
Figure 3C:
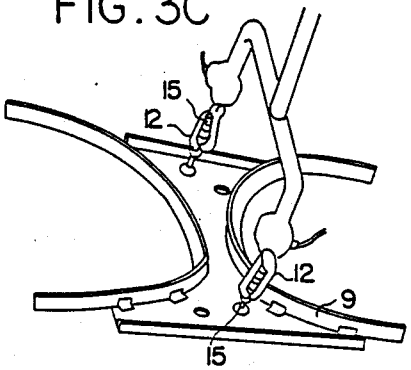
Figure 3D:
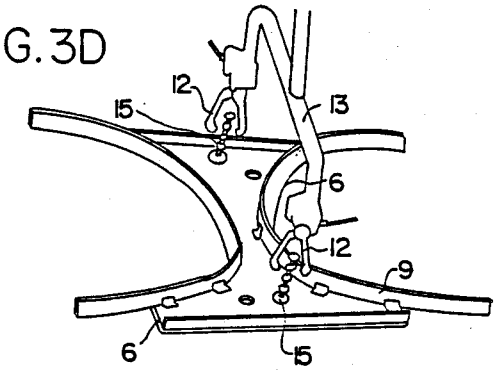

FIG. 3A shows the position of the gripping device 9 before engagement by clamps 12 above the fabric piece 6. FIG. 3B and 3C show gripping device 9 being clamped by clamps 12 before lowering onto the fabric piece 6, and FIG. 3D shows the engagement of the gripping device 9 with fabric piece 6 supported on bench 8 after lowering of said gripping device 9.

The frictional gripping device 9 may have a surface to engage the fabric piece which has a configuration selected so that it will only frictionally contact the fabric piece so pieces 6. Also the perimeter contour of the frictional gripping device 9 is such that it will follow the general perimeter contour of the fabric 6, with only a relatively small portion of the fabric lying outside the area of contact of the frictional gripping device 9 (of FIG. 3D). The necessary degree of frictional grip between the gripping device 9 and the surface of the fabric piece 6 may be achieved by coating or covering the relevant surface of the gripping device with a suitable material to provide the required degree of friction. One suitable material is conventional abrading sheet material sometimes referred to as emery paper.

The degree of frictional grip between this friction material and the fabric such that operation of the air cylinder connected to the carriage supporting plate 7 to draw the plate in the direction from station 2 towards station 1 will cause plate 7 to slide out from beneath the fabric piece 6 whereby fabric piece 6 is progressively transferred onto the bench 8 to be fully supported thereby. The carriage supporting plate 7 now returns to station 1 under the action of the air cylinder and is positioned ready to receive a further piece of fabric 6.

The frictional gripping device 9 may remain in contact with the fabric piece 6, and by moving frictional gripping device 9 in appropriate manner along the bench 8, will affect transfer of the fabric piece along any prescribed path as dictated by the movement of the frictional gripping device 9.

The frictional gripping device may be in the form of the transport member described in greater detail in our co-pending PCT/AU85/00175 patent application previously referred to. That transport member is particularly adapted for passing the fabric piece through a sewing machine head to perform a sewing operation along the contoured edge of the fabric piece. Further information in regard to this manner of feeding the fabric through machine head can be found in that co-pending application.

I claim:

1. A method of transferring a limp fabric piece and capturing said piece along two opposite marginal portions thereof for a subsequent sewing operation along said marginal portions of the fabric piece, comprising (a) freely supporting the fabric piece in a flat state on a first flat low friction surface at one location, (b) moving said first low friction surface with the fabric piece thereon to position the fabric piece in a selected location above a second low friction flat surface, (c) frictionally engaging the exposed surface of the fabric piece at least along two opposite marginal portions of the fabric piece extending in a direction transverse to the direction of movement of said first low friction surface to hold said fabric piece in said flat state at said selected location such that said marginal portions are left protruding beyond said frictional engagement, and (d) removing said first low friction surface from between the fabric piece and said second low friction flat surface so that the fabric piece is deposited in the flat state on said second low friction surface while maintaining the frictional engagement defined in (c) above.

2. A method as set forth in claim 1 wherein the fabric piece is frictionally engaged at a plurality of spaced locations on the exposed surface, the locations being selected so that the fabric piece will remain in a flat state as/or after said first low friction surface has been withdrawn.

3. A method as set forth in claim 1 wherein the fabric piece is frictionally engaged along a major portion of one or two marginal portions of the fabric piece.

4. A method as set forth in claim 3 wherein the frictional engagement is along the full length of the peripheral marginal portion of the fabric piece.

5. A method as set forth in claim 1 wherein two limp fabric pieces are arranged in a superimposed relation and are transferred, at least the lower of the two being frictionally engaged as said first low friction surface is withdrawn.

6. A method as set forth in claim 1 wherein the frictional engagement is along the full length of the peripheral marginal portion of the fabric piece.

* * * * *